US012680778B2

(12) United States Patent
Quail

(10) Patent No.: US 12,680,778 B2
(45) Date of Patent: Jul. 14, 2026

(54) APPARATUS AND METHOD FOR MEASURING AND TRAINING MOVEMENT FOR COMBAT FIREARMS PERFORMANCE

(71) Applicant: Jeffrey James Quail, Winnipeg (CA)

(72) Inventor: Jeffrey James Quail, Winnipeg (CA)

( * ) Notice: Subject to any disclaimer, the term of this patent is extended or adjusted under 35 U.S.C. 154(b) by 1099 days.

(21) Appl. No.: 17/331,287

(22) Filed: May 26, 2021

(65) Prior Publication Data

US 2021/0372729 A1 Dec. 2, 2021

Related U.S. Application Data

(60) Provisional application No. 63/031,003, filed on May 28, 2020.

(51) Int. Cl.
*F41A 33/00* (2006.01)

(52) U.S. Cl.
CPC ..... *F41A 33/00* (2013.01)

(58) Field of Classification Search
CPC ..... F41A 33/00
USPC ..... 434/16
See application file for complete search history.

(56) References Cited

U.S. PATENT DOCUMENTS 4,127,766 A * 11/1978 Thayer ..... G07C 9/00 377/6
4,728,100 A * 3/1988 Smith ..... A63B 24/00 482/3
5,988,645 A * 11/1999 Downing ..... F41J 5/02 250/222.2
6,261,189 B1 * 7/2001 Saville ..... A63B 69/3667 473/266
7,455,621 B1 * 11/2008 Anthony ..... A63B 24/0062 482/3
2016/0138895 A1 * 5/2016 Beine ..... F41J 5/10 434/19
2021/0236376 A1 * 8/2021 Siegel ..... G16H 40/67

* cited by examiner

*Primary Examiner* — Peter S Vasat
*Assistant Examiner* — Stephen Alvesteffer
(74) *Attorney, Agent, or Firm* — Ryan W. Dupuis; Kyle R. Satterthwaite; Ade & Company Inc.

(57) ABSTRACT

An apparatus is used to measure movement performance of a user undergoing firearm combat training. A light emitter emits a light signal along a beam path traversing over a starting location such that the light signal is interrupted by a user at the starting location. A target device initiates a visual representation of a threat directed towards a user at the starting location. A light detector detects a non-interference condition of the light emitter in which the light signal along the beam path is not interrupted at the starting location. A controller monitors the light detector and determines when the user has moved away from the starting location into the non-interference condition of the light emitter. The controller may also measure an elapsed time between activation of the target device and determination of the non-interference condition of the light emitter.

15 Claims, 3 Drawing Sheets

APPARATUS AND METHOD FOR MEASURING AND TRAINING MOVEMENT FOR COMBAT FIREARMS PERFORMANCE

This application claims the benefit under 35 U.S.C. 119(e) of U.S. provisional application Ser. No. 63/031,003, filed May 28, 2020.

FIELD OF THE INVENTION

The present invention relates to an apparatus and a method for measuring and training movement for combat firearms performance.

BACKGROUND

Firearms training for combat requires a radically different approach then traditional target shooting. Target shooting is a static motor skill in which the shooter is attempting to consistently and consistently replicate the same stance, grip and alignment to ensure each shot hits the same desired target. This also means stabilizing their body by firmly planting the feet in place and not moving.

In contrast to this, combat is a dynamic in nature where the shooter is attempting to shoot a human threat that is attacking them in some manner. Training for combat requires developing dynamic motor skills to prevent the attacker from successfully hitting the shooter with either bullets or another weapon, while at the same time allowing the shooter to neutralize the threat to stop the attack.

To facilitate this in either a range or simulator environment, shooters are encouraged to move from their current position while either drawing or acquiring target acquisition and engaging with their firearm. In law enforcement and military, this is often called "getting off the X".

In close combat conditions, like those often experienced by law enforcement officers, the ability for an individual to produce a hidden firearm and attack the officer can occur in milliseconds. An officer with a holstered weapon and no anticipation of a pending attack could never respond by drawing and shooting before the attacker. In these cases, it is imperative they move their head and body at the movement they recognize the bodily movement patterns of an attack unfolding.

SUMMARY OF THE INVENTION

According to one aspect of the invention there is provided an apparatus for measuring movement performance of a user undergoing firearm combat training, the apparatus comprising:

- a target device spaced from a starting location and being arranged to visually represent a threat directed towards the starting location when activated;
- a sensor assembly arranged to detect movement of a user away from the starting location, the sensor assembly comprising:
  - a light emitter arranged to emit a light signal along a beam path traversing over the starting location; and
  - a light detector arranged to detect an interference condition of the light emitter in which the light signal along the beam path is interrupted at the starting location and a non-interference condition of the light emitter in which the light signal along the beam path is not interrupted at the starting location;
- a controller arranged to determine when the target device has been activated and determine when the light detector detects a change from the interference condition to the non-interference condition of the light emitter.

The controller may be further arranged to measure an elapsed time between activation of the target device and detection of a change from the interference condition to the non-interference condition of the light emitter.

The target device may be activated by the controller.

The target device may comprise a display monitor arranged to display a video image that visually represents the threat. The controller may be further arranged to actuate the video image of the target device.

The target device may comprise a visual object including a visual representation of the threat formed thereon, in which the visual object is operable between a visible condition in which the visual representation is visible from the starting location and a non-visible condition in which the visual representation is not visible from the starting location.

The target device may be actuated from the non-visible condition to the visible condition by the controller.

The target device may also comprise a similar weapon arranged to be operated by an operator.

The controller may be arranged to alert the operator to activate the target device.

The controller may be arranged to detect when the target device has been activated by the operator.

The apparatus may further comprise a simulated firearm arranged to be triggered by the user to simulate shooting of the target device by the user, in which the controller is arranged to determine when the simulated firearm has been triggered by the user.

The light emitter may be arranged to emit the light signal such that the beam path traverses the starting location at an elevation corresponding to a torso of the user and/or corresponding to a head of the user.

The light emitter and the light detector may be adjacent to one another such that the sensor assembly further comprises a reflector arranged to be supported along the beam path opposite to the light emitter and light detector in relation to the starting location therebetween, wherein the reflector is arranged to reflect the emitted light signal back across the starting location to the light detector adjacent to the light emitter.

Alternatively, the light detector may be arranged to be supported along the beam path opposite to the light emitter in relation to the starting location therebetween.

According to another aspect of the present invention there is provided a method of measuring movement performance of a user undergoing firearm combat training, the method comprising:

positioning the user at a starting location;

using a light emitter to emit a light signal along a beam path traversing over the starting location such that the light signal is interrupted by the user at the starting location;

initiating a visual representation of a threat directed towards the user at the starting location; and providing a light detector arranged to detect a non-interference condition of the light emitter in which the light signal along the beam path is not interrupted at the starting location;

using a controller to monitor the light detector to determine when the user has moved away from the starting location into the non-interference condition of the light emitter.

When the visual representation of the threat is initiated by activating a target device, the method may further include using the controller to measure an elapsed time between activation of the target device and determination of the non-interference condition of the light emitter.

BRIEF DESCRIPTION OF THE DRAWINGS

Various embodiments of the invention will now be described in conjunction with the accompanying drawings in which.

Figure 3:
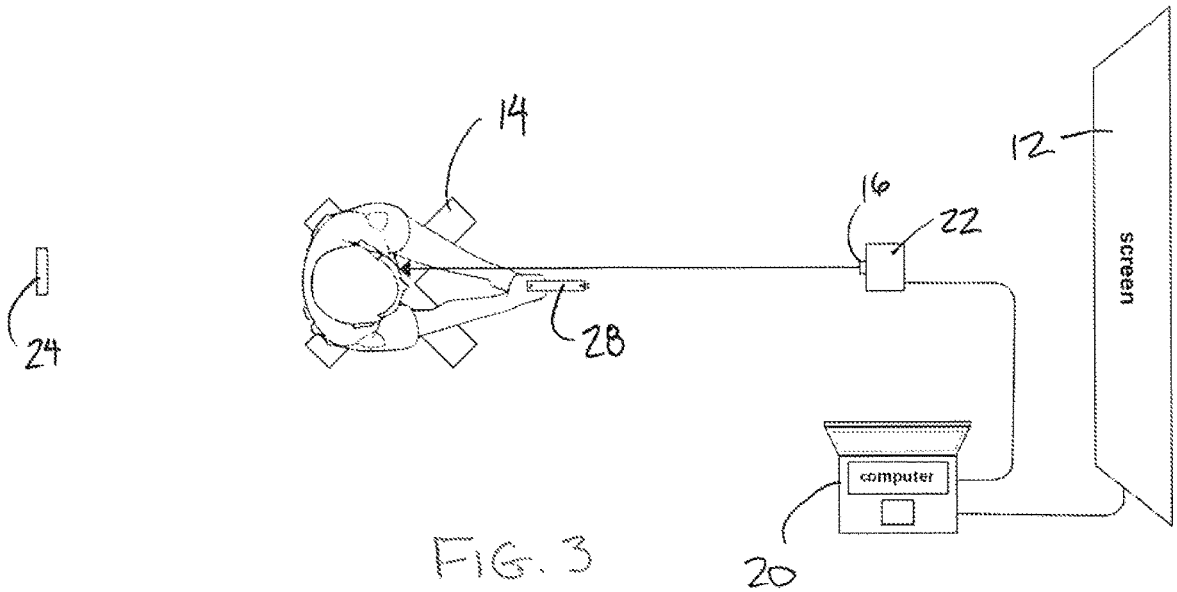
FIG. 3 is a top plan view of the apparatus according to FIG. 1 in the interference condition of the sensor assembly.
Figure 4:
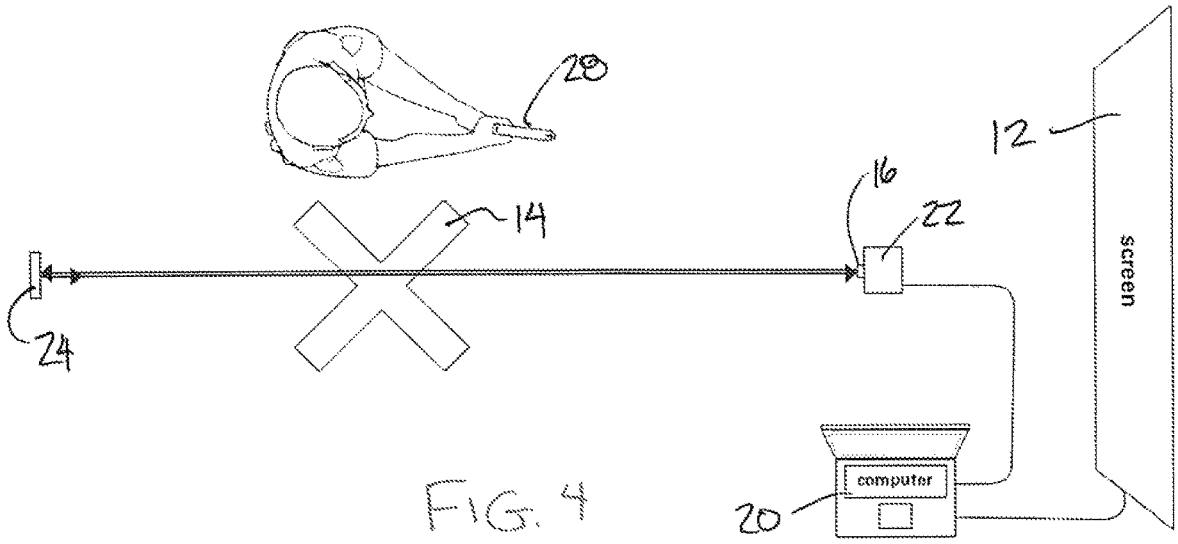
FIG. 4 is a top plan view of the apparatus according to FIG. 1 in the non-interference condition of the sensor assembly.
Figure 5:
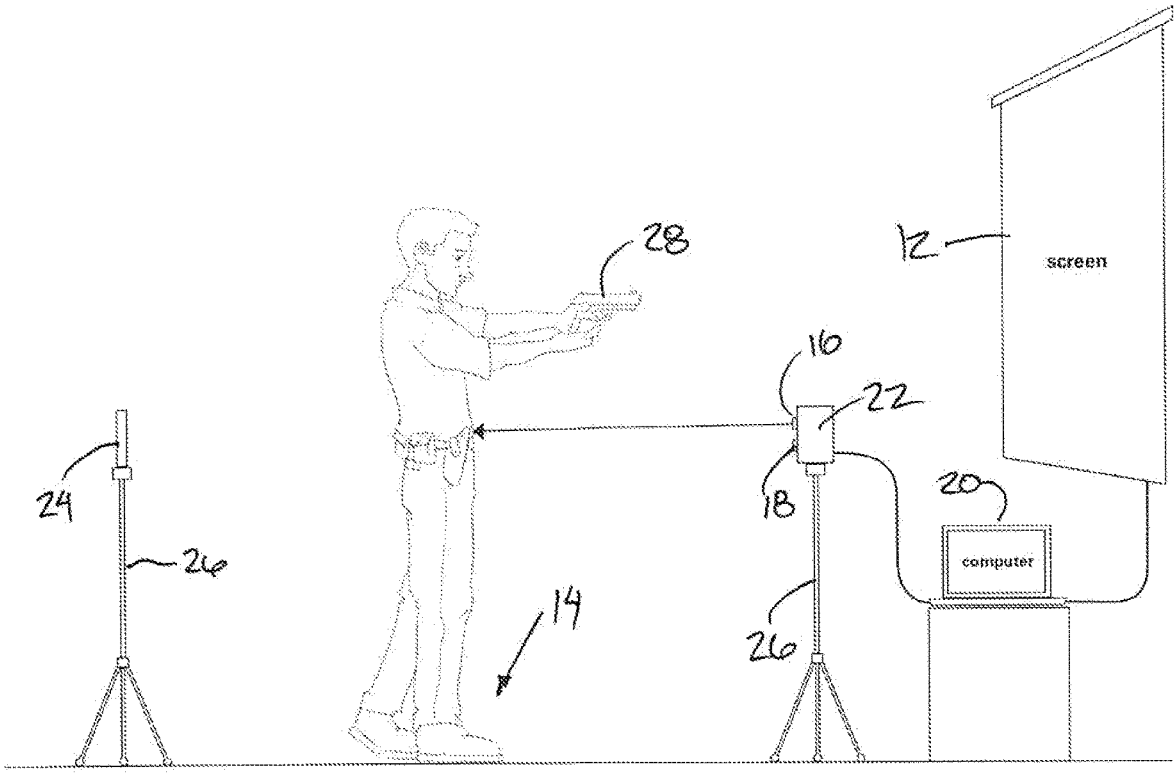
FIG. 5 is a side elevational view of the apparatus in which the beam path is at an elevation of a torso of a user standing at a starting location such that the beam path is interrupted by the user according to the interference condition of the sensor assembly.
Figure 6:
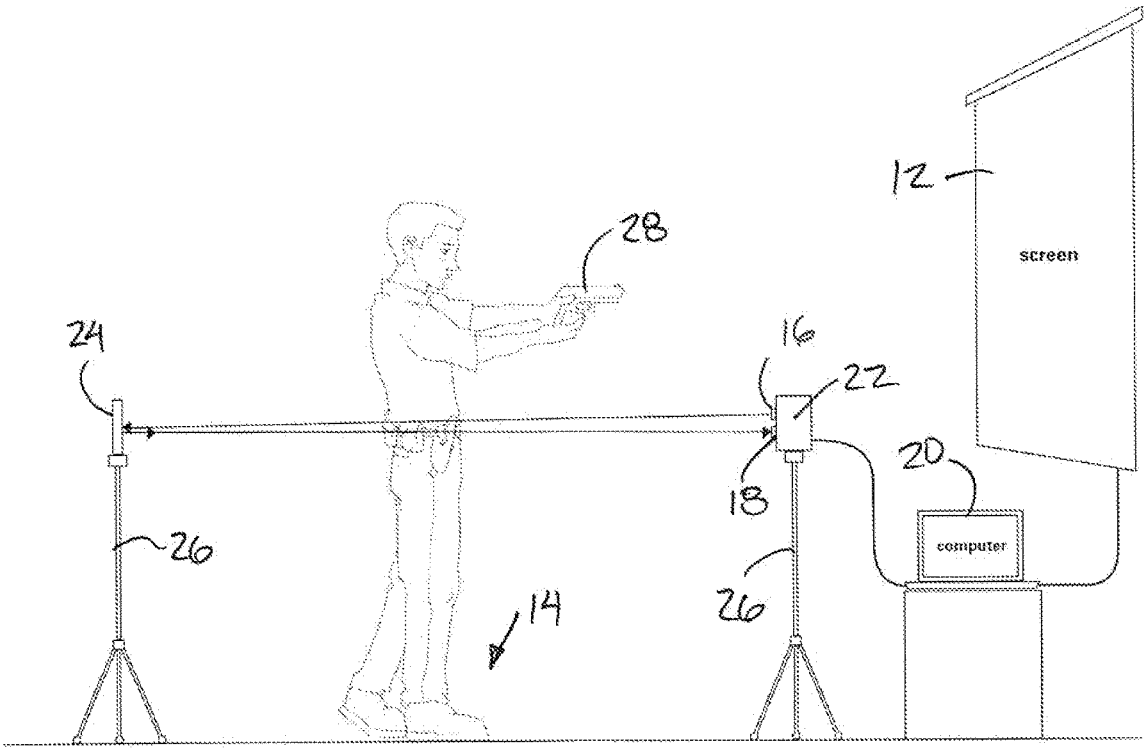
FIG. 6 is a side elevational view of the apparatus according to FIG. 5 after the user has moved away from the starting location such that the beam path is uninterrupted according to the non-interference condition of the sensor assembly.

The top plan views of the apparatus according to FIGS. 5 and 6 are substantially identical to the top plan view shown in FIGS. 3 and 4.

In the drawings like characters of reference indicate corresponding parts in the different figures.

DETAILED DESCRIPTION

Referring to the accompanying figures there is illustrated an apparatus 10 and method of use of the apparatus for measuring and training movement for combat firearms performance.

The apparatus 10 according to the present invention generally includes (i) a target device 12 supported in spaced apart relation from a user standing at a starting location 14 and arranged so as to be viewed by the user at the starting location when activated to visually represent a threat directed towards the user; (ii) a sensor assembly including a light emitter 16 and a light detector 18 used for emitting a light signal along a beam path traversing over the starting location and for detecting when the light signal is no longer interrupted along the beam path at the starting location by the user; and (iii) a controller 20 that is able to determine when the target device has been activated and to determine when there is a change in condition of the light signal from an interference condition interrupted at the starting location to a non-interference condition in which the light signal is not interrupted at the starting location.

The controller 20 typically comprises a computer device including a processor, a memory storing programming instructions thereon which are executable by the processor to perform the various functions of the controller described herein, and a suitable clock or timer for determining a duration between different detected events.

In the illustrated embodiment, the target device 12 comprises a display monitor or screen capable of displaying a video image to the user at the starting location which visually represents a threat directed towards the user at the starting location when activated. In this instance, the display of the video may be activated by the controller, or otherwise communicates with the controller so that the controller can identify when the video image displays a threat that the user must respond to. The controller can thus identify the moment in time when the target device is activated.

The controller is also in communication with the sensor assembly so as to determine a change in condition of the sensor assembly. In the illustrated embodiment the sensor assembly has a sensor housing 22 supporting both the light emitter and the light detector 18 therein. The sensor in this instance thus further includes a separate reflector 24 in which the reflector 24 and the sensor housing 22 are supported on respective stands 26 so as to be situated at opposite sides of the starting location along the beam path with the starting location situated between the reflector and sensor housing. The stands 26 support the reflector and sensor housing elevated above the ground so as to be adjustable in height. The light emitter is arranged to emit the light signal as a focused beam towards the reflector 24 along the beam path such that the reflector functions to reflect the light signal back towards the light detector 18 which is able to detect when the light signal is received. When the light signal is received, the sensor assembly determines that the light signal is not interrupted at the starting location according to a non-interference condition of the light emitter. Alternatively when the light signal is not received by the light detector 18, the sensor assembly determines that the light signal is interrupted according to the interference condition of the light emitter.

The controller records the moment in time that the light detector detects the change in condition from the interference condition to the non-interference condition in response to the user having moved away from the starting location and the beam path. The controller can further calculate the duration between the activation of the target device and the change of condition determined by the light detector.

Figure 1:
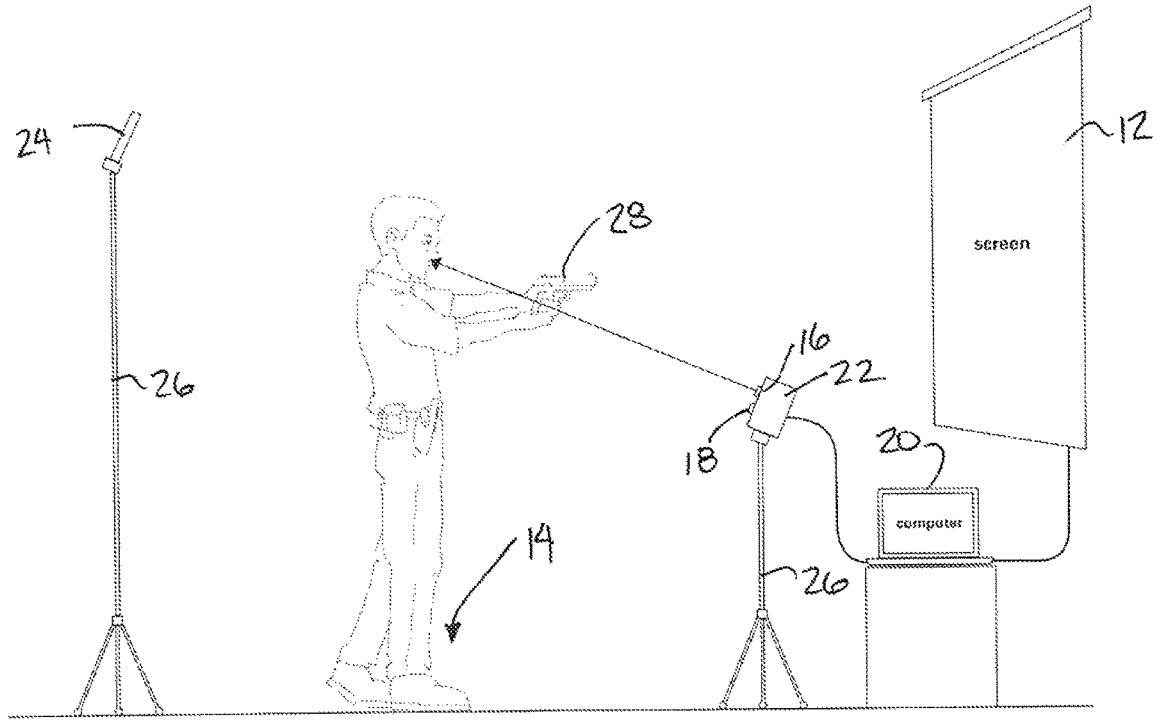
FIG. 1 is a side elevational view of the apparatus in which the beam path is at an elevation of a head of a user standing at a starting location such that the beam path is interrupted by the user according to an interference condition of the sensor assembly.
Figure 2:
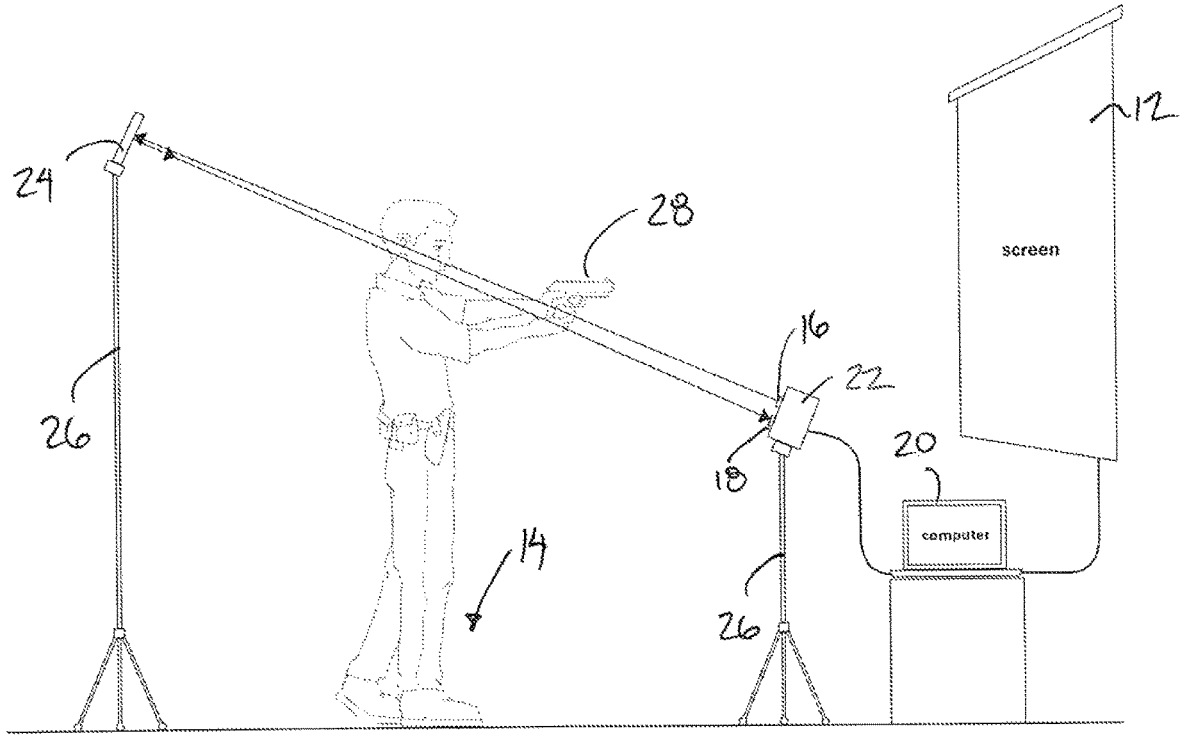
FIG. 2 is a side elevational view of the apparatus according to FIG. 1 after the user has moved away from the starting location such that the beam path is uninterrupted according to a non-interference condition of the sensor assembly.

Due to the adjustable elevation of the stands 26, the beam path of the light signal can be directed across the starting location at an elevation corresponding to the head of the user as shown in FIGS. 1 and 2, or at an elevation corresponding to the torso of the user as shown in FIGS. 5 and 6. In further embodiments, the controller may also communicate with more than one sensor assembly such that more than one beam path is monitored at respective different elevations or at different intersecting paths across the starting location to better identify how the user has moved away from the starting location.

In further embodiments, the target device may be an object, for example a range target, in which the object can be moved or operated between a visible condition which is visible to the user at the starting location and a nonvisible condition which is not visible to the user at the starting location. The movement of the object between visible and nonvisible conditions can be actuated by or detected by the controller 20.

In yet further embodiments, the target device may be a simulated weapon carried by a human operator for simulating a threat directed towards the user at the starting location. In this instance the activation of the target device by the controller may involve the controller generating an alert to the operator to indicate to the operator when they should gesture a threat towards the user with the simulated weapon, or the controller may be capable of detecting a movement of the simulated weapon or gesture of a threat by the operator towards the user.

In further instances, the apparatus 10 may be used together with a simulated firearm 28, for example a simulated weapon capable of generating a light signal simulating a projectile or a firearm which has been adapted for firing a blank cartridge. In this instance, triggering of the simulated firearm 28 by the user at the starting location can also be recorded by the controller using a suitable sensor to detect when the simulated firearm 28 has been triggered. Examples of sensors include an activation button at the trigger location of the simulated firearm, a noise sensor that can detect a blank cartridge being fired, or a light receiving sensor that detects when the simulated weapon has been triggered to generate a light signal simulating a projectile. Recording the moment in time that the simulated firearm has been triggered further allows the controller to measure a duration between the activation of the target device and the triggering of the simulated firearm 28.

In yet further embodiments, the sensor assembly may comprise the light emitter 16 and the light detector 18 being supported on respective stands that are situated at opposite sides of the starting location so as to detect a light signal transmitted in a single direction along the beam path from the light emitter to the light detector in either interference or non-interference conditions thereof.

As described herein, the training methodology according to the present invention utilizes a focused light source, a reflector, focused light source detector, CPU, and power source to assist in having a device that can recognize when a shooter training to move "off the X" has actually moved and record the time it took for the movement to occur from the start of a signal, pattern being presented or any other stimulus desired to start the bodily movement of the shooter. To accomplish this, a focused light source (along with a light sensor) is placed in front of the shooter in a manner that the shooter will block the focused light. The light reflector is placed behind the shooter. When the unit is powered on, the focused light source is blocked by the shooter. When the shooter moves, the focused light source is no longer blocked and the light hits a reflector that reflects it back activating the light detector. In this way we know the shooter has moved from the start position. The CPU can be used to communicate with other devices that can time stamp when the stimulus is first displayed and when the shooter has moved. This provides feedback to the shooter on how fast they are moving "off the X" from the moment the stimulus is displayed.

Method can be embodied a number of ways:

1) The device can be integrated into electronically controlled range targets so that when the targets turn and face the shooter, the time from when the target is displayed until the shooter moves "off the X" can be recorded.
2) The device can be integrated into a shot timer so that the movement time of the shooter can also be captured as a time along with the shot data captured by the shot timer.
3) The device can be integrated into a simulator system so that it can capture the precise time the shooter moved "off the X" when presented with a video or digital sample of a human threat. The time can be captured in relation to the pattern movements of the simulated attackers body. (This could include digital range simulators where range targets are simulated).
4) In force on force training with non-lethal training munitions or laser based firearm simulation systems. The precise time the shooter moves "off the X" in relation to a human role player that is simulating an attack against the shooter.
5) The light can be aligned for measuring the movement of specific body parts, such as the head, arm, torso, etc.

The data captured by the device is used to provide immediate feedback to the shooter on their performance. This feedback can assist the shooter in understanding how quickly or slowly they are reacting to a threat and moving off the line of attack. The use of the device is important as reaction and movement time of shooters is so quick, it is impossible to simply judge with the human eye. The device provides data on response and movement time and allows for objective feedback during training.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An apparatus for measuring movement performance of a user undergoing firearm combat training, the apparatus comprising:

a target device spaced from a starting location and being arranged to visually represent a threat directed towards the starting location when activated;

a sensor assembly arranged to detect movement of a user away from the starting location, the sensor assembly comprising:

a light emitter arranged to emit a light signal along a beam path traversing over the starting location; and a light detector arranged to detect an interference condition of the light emitter in which the light signal along the beam path is interrupted at the starting location and a non-interference condition of the light emitter in which the light signal along the beam path is not interrupted at the starting location;

a controller in communication with the target device and the sensor assembly, the controller comprising a processor and a memory storing programming instructions thereon, the programming instructions of the controller, when executed by the processor, being configured to: (i) determine when the target device has been activated, (ii) determine when the light detector detects a change from the interference condition to the non-interference condition of the light emitter, and (iii) measure an elapsed time between activation of the target device to visually represent a threat directed towards the starting location and detection of the change from the interference condition to the non-interference condition of the light emitter indicative of the movement of a user away from the starting location.

2. The apparatus according to claim 1 wherein the target device is activated by the controller.

3. The apparatus according to claim 1 wherein the target device comprises a display monitor arranged to display a video image that visually represents the threat.

4. The apparatus according to claim 3 wherein the controller is arranged to actuate the video image of the target device.

5. The apparatus according to claim 3 wherein the target device is actuated from the non-visible condition to the visible condition by the controller.

6. The apparatus according to claim 1 wherein the target device comprises a visual object including a visual representation of the threat formed thereon, the visual object operable between a visible condition in which the visual representation is visible from the starting location and a non-visible condition in which the visual representation is not visible from the starting location.

7. The apparatus according to claim 1 wherein the target device comprises a similar weapon arranged to be operated by an operator.

8. The apparatus according to claim 7 wherein the controller is arranged to alert the operator to activate the target device.

9. The apparatus according to claim 7 wherein the controller is arranged to detect when the target device has been activated by the operator.

10. The apparatus according to claim 1 further comprising a simulated firearm arranged to be triggered by the user to simulate shooting of the target device by the user, the controller being arranged to determine when the simulated firearm has been triggered by the user.

11. The apparatus according to claim 1 wherein the light emitter is arranged to emit the light signal such that the beam path traverses the starting location at an elevation corresponding to a torso of the user.

12. The apparatus according to claim 1 wherein the light emitter is arranged to emit the light signal such that the beam path traverses the starting location at an elevation corresponding to a head of the user.

13. The apparatus according to claim 1 wherein the light emitter and the light detector are adjacent to one another and wherein the sensor assembly further comprises a reflector arranged to be supported along the beam path opposite to the light emitter and light detector in relation to the starting location therebetween, the reflector being arranged to reflect the emitted light signal back across the starting location to the light detector adjacent to the light emitter.

14. The apparatus according to claim 1 wherein the light detector is arranged to be supported along the beam path opposite to the light emitter in relation to the starting location therebetween.

15. A method of measuring movement performance of a user undergoing firearm combat training, the method comprising:

positioning the user at a starting location;

using a light emitter to emit a light signal along a beam path traversing over the starting location such that the light signal is interrupted by the user at the starting location;

activating a target device spaced from the starting location to initiate a visual representation of a threat directed towards the user at the starting location;

providing a light detector arranged to detect a non-interference condition of the light emitter in which the light signal along the beam path is not interrupted at the starting location;

providing a controller in communication with the target device and the light detector, the controller comprising a processor and a memory storing programming instructions thereon arranged to be executed by the processor;

using the controller, monitoring the light detector to determine when the user has moved away from the starting location by detecting the non-interference condition of the light emitter; and using the controller, measuring an elapsed time between activation of the target device to initiate the visual representation of the threat directed towards the user at the starting location and determination of the non-interference condition of the light emitter corresponding to the user moving away from the starting location.

* * * * *